US006983805B2

(12) United States Patent
Chattaway

(10) Patent No.: US 6,983,805 B2
(45) Date of Patent: Jan. 10, 2006

(54) FIRE BLANKET

(75) Inventor: Adam Chattaway, Staines (GB)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 98 days.

(21) Appl. No.: 10/203,697

(22) PCT Filed: Feb. 9, 2001

(86) PCT No.: PCT/GB01/00575

§ 371 (c)(1),
(2), (4) Date: Nov. 8, 2002

(87) PCT Pub. No.: WO01/58529

PCT Pub. Date: Aug. 16, 2001

(65) Prior Publication Data

US 2003/0155134 A1 Aug. 21, 2003

(30) Foreign Application Priority Data

Feb. 14, 2000 (GB) ..... 0003349
Jan. 9, 2001 (GB) ..... 0100529

(51) Int. Cl.
*A62C 2/00* (2006.01)
*A62C 3/00* (2006.01)
*A62C 8/00* (2006.01)

(52) U.S. Cl. ..... 169/46; 169/47; 169/48; 169/49; 169/50; 169/36

(58) Field of Classification Search ..... 169/46, 169/47, 48, 49, 50, 36
See application file for complete search history.

(56) References Cited

U.S. PATENT DOCUMENTS

| | | | | |
|---|---|---|---|---|
| 2,340,370 | A * | 2/1944 | Doyle | 169/50 |
| 3,782,475 | A * | 1/1974 | Schmidt | 169/50 |
| 3,902,559 | A | 9/1975 | Everingham et al. | |
| 4,612,239 | A | 9/1986 | Dimanshteyn | |
| 4,624,320 | A | 11/1986 | Romaine | |
| 4,756,839 | A | 7/1988 | Curzon et al. | |
| 5,032,446 | A | 7/1991 | Sayles | |
| 5,378,530 | A | 1/1995 | Metivaud et al. | |
| 5,490,567 | A * | 2/1996 | Speer | 169/50 |
| 5,849,210 | A * | 12/1998 | Pascente et al. | 169/46 |
| 6,297,178 | B1 * | 10/2001 | Berbner et al. | 442/302 |
| 6,319,573 | B1 * | 11/2001 | Lokken | 169/48 |

FOREIGN PATENT DOCUMENTS

| | | |
|---|---|---|
| DE | 2917639 | 11/1980 |
| EP | 0059178 | 9/1982 |
| GB | 1 444 750 | 8/1976 |
| GB | 2 157 560 A | 10/1985 |
| WO | WO 93/21995 | 11/1993 |
| WO | WO 99/11327 | 3/1999 |

* cited by examiner

*Primary Examiner*—David A. Scherbel
*Assistant Examiner*—Darren Gorman
(74) *Attorney, Agent, or Firm*—Merchant & Gould P.C.

(57) ABSTRACT

A fire blanket comprising a generally flexible substrate and a chemical compound which reacts endothermically when heated. The chemical compound is preferably an alkali metal salt and more preferably a potassium or sodium salt. The compound may be a solid at room temperature s or forms an alkali solution.

12 Claims, 3 Drawing Sheets

Fire Blanket Tests
t=2min,
Blanket applied
t=17min,
Blanket removed
Water
baseline:
restrike-test
abandoned
Test 1: Water baseline
Test 2: Potassium acetate
Test 3: Potassium acetate,
additional agent applied
Test 4: Sodium acetate (solid)
Temperature/C
Time/min
400
380
360
340
320
300
280
260
240
0
2
4
6
8
10
12
14
16
18
20

FIRE BLANKET

FIELD OF THE INVENTION

This invention relates to a fire blanket which is used typically to extinguish cooking oil fires.

BRIEF SUMMARY OF THE INVENTION

In accordance with the invention, there is provided a fire blanket, comprising a flexible substrate with a chemical fire-extinguishing compound which reacts endothermically when heated, the substrate being configured to be porous to the chemical compound to allow the chemical compound to permeate therethrough towards and onto a source of heat when the chemical compound is melted, the substrate having a cellular construction and wherein the chemical compound is held in the cells.

BRIEF DESCRIPTION OF THE DRAWINGS

Fire blankets in accordance with the invention will now be described by way of example with reference to FIGS. 1 and 2, which respectively show plots of temperature against time for different fire blankets under test, and FIGS. 3 and 4, which respectively show a scrap plan view of one of the blankets and a scrap cross-section along the lines IV—IV of FIG. 3.

DETAILED DESCRIPTION OF EMBODIMENTS OF THE INVENTION

Figure 1:
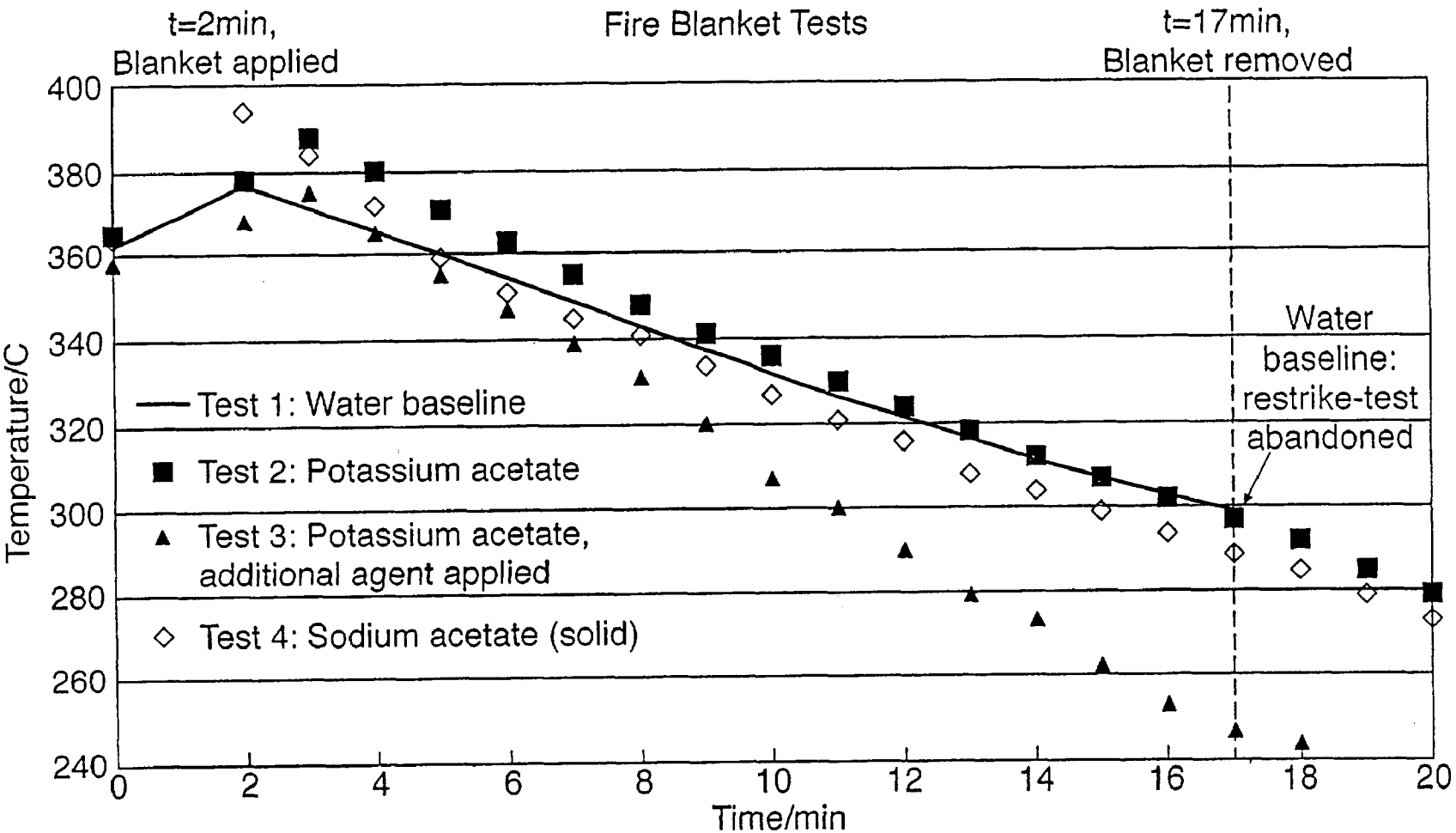

Cooking oil or fat fires are a common source of fire in the home. These fires are particularly dangerous because the temperature of the underlying oil may be above its auto-ignition temperature. Thus, cooking oil fires have a tendency to reignite or restrike when oxygen is available after initially extinguishing the fire. Furthermore, most conventional suppression compounds such as water, $CO_2$ foam or multipurpose dry chemicals, are ineffective against cooking oil fires.

The conventional approach to extinguishing cooking oil fires is therefore to use a fire blanket. Such fire blankets rely on the exclusion of oxygen to extinguish the fire. Often, due to the high temperatures involved (up to 360° C.) these fire blankets are made of woven glass fibres. Optionally, fire blankets may be coated to improve exclusion of air however, fire blankets should be flexible enough to form a seal about a seat of a fire such as a cooking pan in order to inhibit oxygen availability to the fire and hot oil in the pan.

Existing fire blankets have several problems. Where blankets are uncoated, the exclusion of oxygen relies entirely on the quality of the weave of the blanket. Any defects in the weave renders the blanket less effective in excluding oxygen and may allow oil vapour to escape above the blanket where it may auto-ignite to present a flame there.

Where a fire blanket coating is used, the coated fire blanket tends to be stiffer than a similar uncoated blanket. This stiffness reduces the effectiveness of sealing of the blanket around the periphery of the pan containing the cooking oil fire and so the effectiveness of oxygen exclusion from the hot oil and fire. Also, the coating is usually in the form of a silicon rubber which may itself sometimes be flammable.

Even if it is possible to extinguish the fire, as noted above, the hot oil which fuelled the fire bums above its auto-ignition temperature and therefore may readily restrike if oxygen is allowed back into contact with the oil by removing the blanket. This problem is exacerbated by the tendency for the oil to degrade during burning and thereby to have a reduced auto-ignition temperature. For example, the typical auto-ignition temperature of cooking oil (which is predominantly composed of fatty acid esters) is about 360° C. After burning, the auto-ignition temperature of cooking oil may become as low as 300° C.

In commercial restaurants, wet chemical compounds are sometimes used instead of a fire blanket. These compounds may be deployed either in fixed systems or in specially modified portable hand extinguishers. However, this approach is not suitable for domestic use in the home where the simplicity and easy storage of a fire blanket is advantageous.

The present invention overcomes these problems by adding chemically active compounds to a fire blanket so that the fire blanket no longer relies entirely on the exclusion of oxygen to extinguish an oil fire.

Preferably, a wet or low melting temperature chemical compound such as an alkali metal salt, e.g. potassium or sodium acetate, lactate, citrate or carbonate is included in the fire blanket so that the fire blanket operates to extinguish a fire by excluding oxygen and by chemical means. The chemically acting agent or compound may be in the form of a low temperature melting solid or may be carried in-suspension by a carrier liquid such as by being in the form of an aqueous solution.

Dry chemical extinguishers have used alkali metal salts such as sodium bicarbonate for some time as described, for example, in Sheinson, RS, "Fire Suppression by Fine Solid Aerosol"; Proceedings of the International CFC and Halon Alternatives Conference, Wash., D.C., 24–26, Oct. 1994, pages 414–421.

In order to be effective both to exclude oxygen and for chemical suppression of a fire it will be understood that the chemical compound must approach the fire. Thus, the fabric substrate of a fire blanket, although of low permeability to air in order the exclude oxygen, should be configured to allow the melted chemical compound or aqueous solution to pass through it. The chemical compound will then engage the fire to extinguish it by chemical means i.e. by endothermic action.

By incorporating alkali metal salts (typically sodium or potassium salts) into the blanket, advantage may be taken of the endothermic decomposition of these compounds when heated. Since the decomposition is endothermic, heat is taken out of the fire which improves cooling of the oil and therefore reduces the possibility of the hot oil restriking into a fire when oxygen is again available. Furthermore, the decomposition may release water which further cools the oil by evaporation. Similarly, any carrier solution associated with the chemical compound may evaporate rather than drip through the blanket. Such evaporation of the carrier solution is generally a very endothermic (heat absorbing) process and so should further cool the hot oil and its environment.

Additionally, if the chemical compound produces a salt solution which is alkaline, then the solution reacts chemically with the cooking oil to saponify the oil to produce a crust or lumps of generally inflammable "soap". This saponification therefore further reduces the chance of re-ignition of the hot cooking oil.

With reference to FIG. 1, the results of tests 1 to 4 respectively showing use of a wet fire blanket, a fire blanket pre-wetted with potassium acetate, a fire blanket pre-wetted and subsequently re-wetted with potassium acetate and a fire blanket with sodium acetate applied are graphically depicted.

All tests were conducted using a 285 mm diameter aluminium pan. In all other respects the tests followed the standard test protocol set out in British Standard—European Norm (BSEN) 1869.

Test 1—Wet Blanket

Three liters of cooking oil in a pan were heated to its auto-ignition temperature (362° C.) and the oil allowed to burn for two minutes. A water pre-soaked fire blanket was then applied and the pan left to stand. As expected, fire extinction occurred almost instantly. Control of the pan and hot oil was maintained for 15 minutes thereafter until the blanket was removed. After the blanket was removed, the fire reignited after approximately 20 seconds and so failed the BS 1869 test. Thus, this wet blanket was shown to be inadequate as an effective fire blanket; it did not reduce the temperature of the hot cooking oil to below its auto-ignition temperature within a reasonable length of time as defined by the BS 1869 test.

Test 2—Blanket Soaked in Potassium Acetate Solution

Test 2 was conducted with the same procedure as used in Test 1. Tea towel fabric was soaked in a 40% aqueous solution of potassium acetate to form a fire blanket before being applied to the pan containing burning cooking oil. The fire was extinguished immediately and remained under control for 15 minutes. After removal of the blanket at the end of a 15 minute controlled time period, the hot oil did not restrike into a fire for at least 3 minutes. This constituted a pass to British/European Standard (BSEN) 1869:1997.

At the end of the test 2, the tea towel fabric of the fire blanket was slightly charred (but less so than in Test 1). It is believed that the high concentration of potassium salts prevented the fire from causing as much damage to the underlying tea towel fabric material.

Test 3—Blanket Soaked in Potassium Acetate Solution and then Additional Potassium Acetate Solution Added After Fire Suppression Test 3 was carried out as for Test 2 but additional 40% aqueous solution of potassium acetate was periodically applied to the top of the tea towel material forming the fire blanket during the 15 minute controlled time period after extinguishing the fire in the cooking oil. Addition of more 40% aqueous solution of potassium acetate to the fire blanket as expected produced further cooling of the hot oil by evaporation of the water and also more effective saponification of that oil due to the greater availability of potassium acetate. During the additional application of potassium acetate solution, hissing and boiling occurred due to the flash evaporation of the aqueous solution.

The addition of about 150 ml of 40% aqueous potassium acetate solution resulted in a much higher degree of cooling as shown in FIG. 1 by the curve associated with Test 3. The fire blanket at the end of Test 3 appeared less charred than in test 2, although the underside was rather oily due to the boiling and frothing that had occurred during the second application of 40% aqueous potassium acetate solution to the fabric substrate of the blanket. A quantity of the oil residue at the end of the test was collected and analysed for saponification. A small spectral peak at 1560 $cm^{-1}$ was observed which indicates that some saponification of the oil had taken place. The amount of saponification does not appear to have been significant and it is likely that the major chemical fire suppression mechanism in test 3 was cooling of the oil by the endothermic reactions described above.

Test 4—Sodium Acetate Trihydrate

Sodium acetate trihydrate has a melting point of about 58° C. and thus may be applied to a fabric substrate of a fire blanket or secured therein in solid form. During fire extinguishing, the sodium acetate trihydrate compound will then melt and drop into the hot cooking oil. Test 4 was conducted as with the above tests and the fire was held extinguished for 15 minutes and did not reignite for at least 3 minutes after removal of the blanket from the pan.

An examination of FIG. 1, and in particular the curve associated with test 4, shows that sodium acetate trihydrate in a blanket leads to a higher initial cooling rate. This may be due to the sodium acetate trihydrate compound first melting and then losing water; both of these processes being endothermic.

Tests 1 to 4 show that improved fire extinguishing can be achieved using a "chemically active" fire blanket. The chemically active component is typically an alkali metal salt and preferably a potassium or sodium salt. Preferably, to cause saponification, the solution produced with the oil by the chemically active compound is alkaline.

The chemically active compound as a solution may be pre-impregnated into the blanket or applied to the blanket immediately before (and optionally during) application of the blanket to the fire. In the case of a solid chemically active compound such as sodium acetate trihydrate, the compound can be held between substrate or fabric layers of the blanket (for example by stitching pockets or cells into the blanket to retain the solid compound in powder or pellet form until released by melting through the blanket toward and onto the fire). Alternatively, an absorbent layer of foam or similar material could be sandwiched between substrate or fabric layers of the blanket or simply secured to the blanket in order to store a solution or solid volume of chemically active compound until needed. However, the fabric of the blanket should generally remain substantially stable to ensure oxygen exclusion. The chemically active compound, whether in a solution or as a melt, permeates through the weave via a combination of capillary action and gravity towards the seat of the fire.

The original structural integrity of the fire blanket substrate fabric remains intact without breakage or rupture to release the chemically active compound from the blanket to engage the fire and underlying oil. Such structural integrity of the blanket ensures a good barrier is presented to stop air/oxygen reaching the hot oil or fire for further propagation and/or re-ignition.

Figure 2:
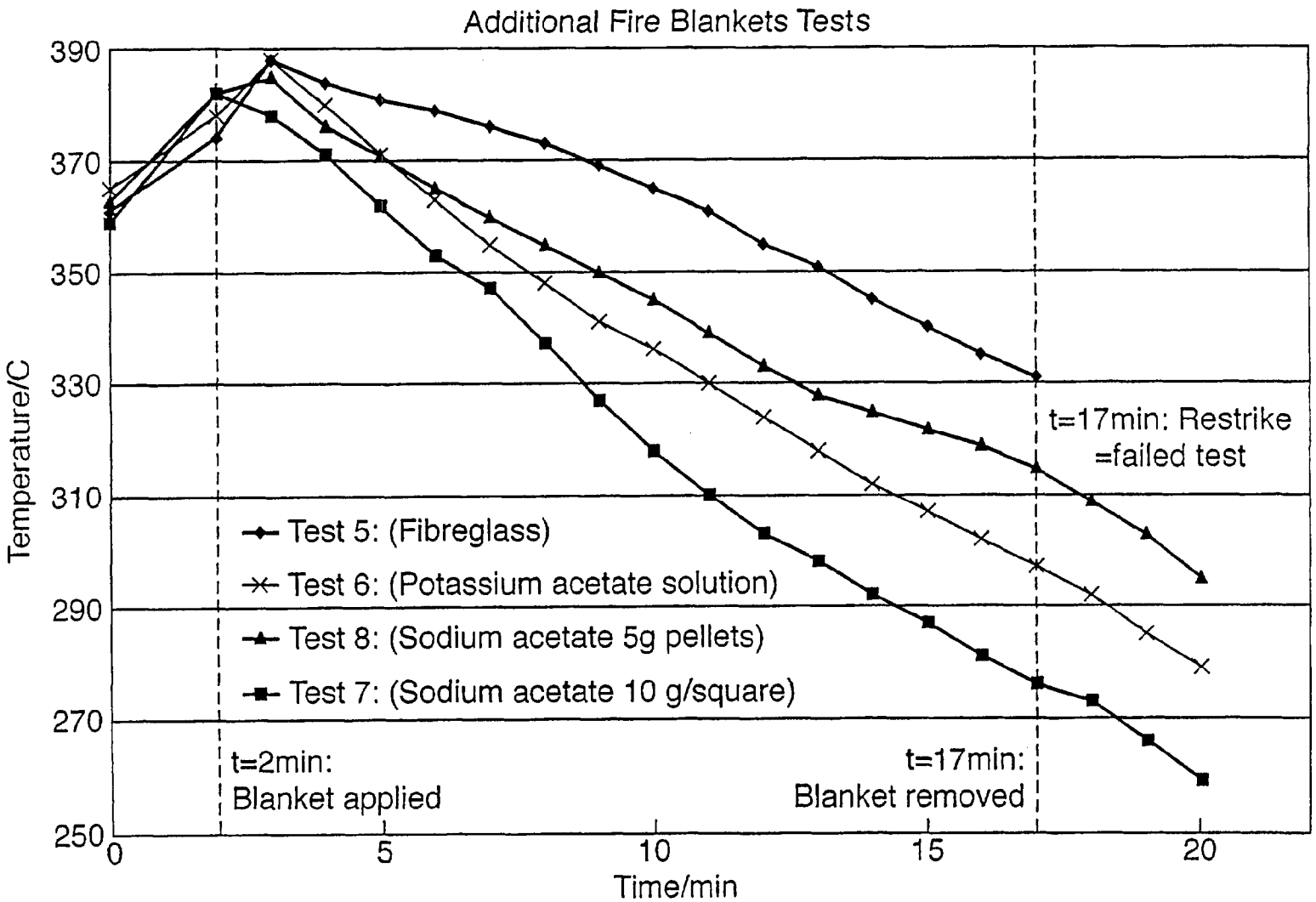

FIG. 2 shows the results of Tests 5 to 8 which respectively relate for comparison to a fibreglass fire blanket, a fire blanket soaked in potassium acetate and two fire blankets including sodium acetate trihydrate held in powder and in pellet form.

Test 5—Fibreglass Blanket

Three liters of cooking oil was heated in a pan to its auto-ignition temperature (362° C.) and allowed to burn for two minutes. A proprietary fibreglass fire blanket was applied over the pan and the pan left to stand. Fire extinction occurred instantly as expected due to lack of oxygen availability to the fire. Control was maintained for 15 minutes thereafter until the blanket was removed. The fire reignited after approximately 20 seconds. This constitutes a failure according to the BS 1869 test. FIG. 2 shows through the curve associated with test 5 that the cooling of the oil during test 5 was comparatively poor and the temperature of the oil had only decreased by about 30° C. in the 17 minutes following initial auto-ignition. This is typical of a conventional fire blanket where there is no provision for active cooling of the oil. It is also worth noting that the tested blanket was a proprietary blanket which had previously been awarded the BSEN 1869:1997 certification, thus indicating the small safety factor in conventional fire blanket performance.

Test 6—Blanket Soaked in Potassium Acetate

Test 6 was conducted as in Test 5. A cotton tea towel was soaked in a 40% aqueous solution of potassium acetate to form a fire blanket before being applied to the pan. The fire was extinguished immediately and remained under control for 15 minutes. After removal of the blanket at the 15 minute point, the fire did not restrike for at least 3 minutes. This constitutes a full pass to BSEN 1896: 1997. From the curve in FIG. 2 associated with test 6, it can be seen that the aqueous solution of potassium acetate produced significant cooling of the hot oil, to the extent that the oil temperature when the blanket was removed was reduced to 297° C. which is below its new auto-ignition temperature of about 300 to 310° C. This is typical of the additional cooling that is possible when a chemically active compound is employed in the fire blanket.

A quantity of the oil residue at the end of test 6 was collected and analysed by infrared spectroscopy for evidence of saponification. A small spectral peak at 1560 $cm^{-1}$ was observed which indicates that some saponification had taken place. The amount of saponification does not appear to have been significant, and it is likely that the major suppression mechanism in test 6 was cooling of the oil, principally by the potassium acetate.

Tests 7 and 8—Sodium Acetate Trihydrate

In Test 7, a fire blanket was formed from a lightweight cotton sheet quilted into nine 90 mm squares comprising a 3×3 matrix and with 10 g of sodium acetate trihydrate powder placed in each square. During fire extinguishing, the sodium acetate trihydrate compound melts and drops through the cotton sheet onto the burning hot oil. Test 7 was conducted as with the tests above and the fire was held extinguished for 15 minutes and did not reignite for at least 3 minutes after removal of the blanket.

Test 8 was carried out in a similar fashion to test 7 with nine 90 mm squares in the quilted cotton sheet, but with each square containing a respective sodium acetate trihydrate pellet weighing 5 g. Again, the sodium acetate trihydrate pellet melted and dropped through the cotton fabric to extinguish the fire.

An examination of FIG. 2 with regard to tests 7 and 8 shows that the addition of sodium acetate trihydrate leads to a higher initial cooling rate, and that the cooling rate is proportional to the amount of sodium acetate trihydrate added. This is due to the sodium acetate trihydrate first melting and then loosing water which are both endothermic processes.

Tests 5 to 8 again show that improved fire extinguishing is achieved using a "chemically active" fire blanket. The chemically active component is typically an alkali metal salt and normally a potassium or sodium salt. Preferably, in order to cause saponification, the solution produced by the chemically active compound is alkaline.

Figure 3:
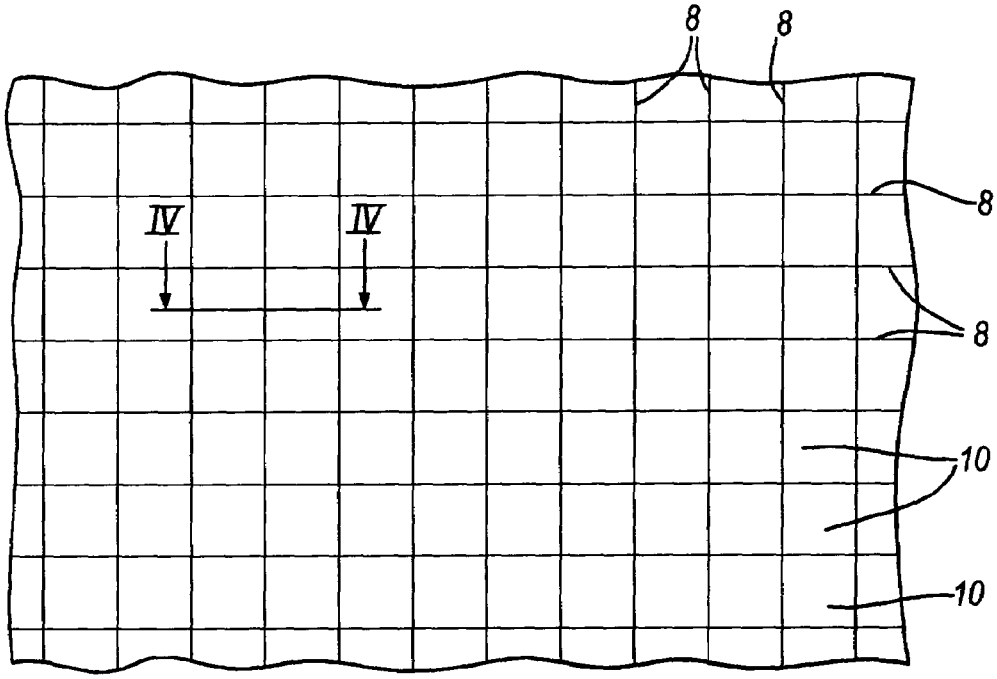
Figure 4:
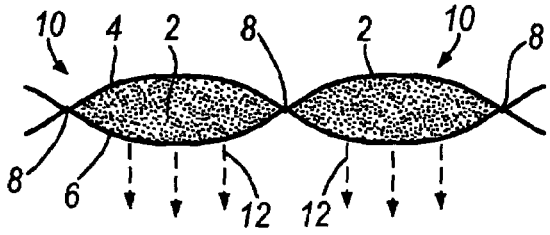

The chemically active compound as a solution may be impregnated into the blanket or applied to the blanket just before (and optionally during) application of the blanket to the fire. In the case of a solid compound such as sodium acetate trihydrate, the compound 2 (see FIG. 4) may be held between fabric or substrate layers 4, 6 (FIG. 4) of the blanket (for example by stitching the two layers 4, 6 together along lines 8, 8, as shown in FIG. 3, to form cells 10 in the blanket). Alternatively, certain fabrics may be "welded" by a brief application of heat along the lines 8, 8, allowing easy fabrication of the cells 10 to contain the solid compound.

It is important that the fire blanket creates an air-tight barrier to starve the fire of oxygen. Thus, the underlying fabric 4, 6 must be flexible and be able to retain the chemically active component i.e. sodium acetate trihydrate and then remain "wetted" by the melt or solution in order to provide the air barrier once the chemically active compound 2 has dripped through (as shown by the dashed arrows 12 in FIG. 3) onto the seat of the fire. Clearly, in such circumstances, it is necessary to select the fabric carefully in terms of its weight (gsm), its weave and thread fiber denier etc. Typically, the fabric substrate will retain some of the melted chemically active compound by surface tension. This retained melted compound will seal holes in the fabric weave and so create at least a partially air-tight barrier to starve the fire of oxygen. Although a woven cloth is preferred, it would be understood that in some situations a non-woven felt or other substrate may be used. The fabric weave density is the key to maintaining air (oxygen) exclusion from the hot oil to initially extinguish the fire and then prevent auto-ignition if the oil is sufficiently hot.

A typical fabric will have a simple 1×1 weave with a 50% cotton/50% polyester thread. A suitable fabric is made by Copland Fabric of Burlington, N.C. 27216 U.S.A. under their style code 10015/1. However, it will be understood that tea towel or bed sheet materials may be used and, rather than a simple weave, cross-woven or bow weave materials could be used. Typically, in the fabric the thread, both in weft and warp, will be about 35/1 denier and there will be around 45 to 50 threads per inch. However, 50 threads per inch is preferred in order to provide a fabric which is tight enough to retain the chemically active compound 2 when stored but sufficiently open to allow the compound 2 to drip through (see dashed arrows 12 in FIG. 3) to a fire when melted. Clearly, it may be possible to use fabrics which have a slightly more open weave than previous fire blankets as the chemical compound, either as a melt or solution, may be able to seal the more open structure to prevent air (oxygen) access to the fire and hot oil.

The weight and thickness of the fabric are important in order that the fabric retains sufficient chemically active compound to drip through to the fire to be effective in use and to seal the fabric whilst not being too bulky for storage.

The fabric should also be able to retain the chemically active compound either in solid form or solution within its structure. Clearly, if the fabric could not retain these chemically active compounds then the blanket would rapidly age and may prove unreliable; fire blankets need to be stored near to a fire hazard with little maintenance but be readily available for effective fire extinguishing.

The primary means of fire extinguishing by the present fire blanket is by limiting oxygen availability to the hot oil. However, inclusion of chemically active compounds such as sodium acetate trihydrate enhances fire extinguishing action by removing heat and by reducing fuel (i.e. cooking oil) temperatures to inhibit restrike when the blanket is removed and oxygen is available again. The fabric must maintain the oxygen limiting feature whilst acting as a matrix to store, present and distribute the chemically active compound to reduce temperatures.

Thus, the specific choice of fabric and chemically active compound combination will depend upon requirements, storage conditions, cost etc.

As alternatives to sodium acetate trihydrate, it may be possible where conditions allow, to use potassium acetate or potassium citrate as the chemically active compound.

What is claimed is:

1. A fire blanket for extinguishing domestic fires, comprising a flexible substrate with a chemical fire-extinguishing compound, the compound reacting endothermically when heated by the temperature of the domestic fire and is melted thereby into and remains in liquid form, the substrate being configured to be porous to the chemical compound when the chemical compound is in its liquid form to allow the chemical compound to permeate through the substrate towards and onto the domestic fire, the substrate having a cellular construction and wherein the chemical compound is held in the cells of the substrate until it is melted.

2. A fire blanket according to claim 1, wherein the chemical fire-extinguishing compound is an alkali metal salt.

3. A fire blanket according to claim 1, wherein the chemical fire-extinguishing compound has a pH greater than 7.

4. A fire blanket according to claim 1, wherein the chemical fire-extinguishing compound has a pH greater than 8.

5. A fire blanket according to claim 4, wherein the chemical compound has a pH greater than 9.

6. A fire blanket according to claim 1, wherein the chemical fire-extinguishing compound releases water when heated.

7. A fire blanket according to claim 1, wherein the chemical fire-extinguishing compound has a melting point greater than 30° C. and less than 50° C.

8. A fire blanket according to claim 1, wherein the chemical fire-extinguishing compound is a salt of potassium or sodium.

9. A fire blanket according to claim 1, wherein the chemical fire-extinguishing compound is sodium acetate trihydrate or potassium acetate or potassium citrate.

10. A method of extinguishing a domestic fat fire burning in a container, comprising the steps of forming a fire blanket comprising a flexible substrate of cellular construction, applying a chemical fire-extinguishing compound to the substrate and holding it in the cells thereof, the chemical fire-extinguishing compound reacting endothermically when heated by the temperature of the domestic fire and being melted thereby into and remaining in liquid form, the substrate being porous to the chemical compound when the chemical compound is in its liquid form so that the chemical compound can permeate in use through the substrate towards and onto the fire, and laying the blanket over the container.

11. A method of extinguishing a domestic fat fire burning in a container, comprising the steps of forming a fire blanket comprising a flexible substrate of cellular construction, applying a chemical fire-extinguishing compound to the substrate and holding it in the cells thereof, the chemical fire-extinguishing compound reacting endothermically when heated by the temperature of the domestic fire and being melted thereby into and remaining in liquid form, the substrate being porous to the chemical compound when the chemical compound is in its liquid form so that the chemical compound can permeate in use through the substrate towards and onto the fire, laying the blanket over the container, and applying additional quantities of the chemical compound to the substrate while the fire blanket is laying over the container.

12. A fire blanket for extinguishing domestic fires, comprising a flexible substrate with a chemical fire-extinguishing compound, the compound reacting endothermically when heated by the temperature of the domestic fire and is melted thereby into and remains in liquid form, the substrate being configured to be porous to the chemical compound when the chemical compound is in its liquid form to allow the chemical compound to permeate through the substrate towards and onto the domestic fire, the substrate having a cellular construction and wherein the chemical compound is held in the cells of the substrate until it is melted, and the chemical fire-extinguishing compound is sodium acetate trihydrate or potassium acetate or potassium citrate.

* * * * *